United States Patent [19]

Li

[11] 4,072,344

[45] Feb. 7, 1978

[54] CONVECTIVELY AIR-VENTILATED FURNITURE

[76] Inventor: Chou H. Li, 379 Elm Drive, Roslyn, N.Y. 11576

[21] Appl. No.: 713,254

[22] Filed: Oct. 14, 1976

[51] Int. Cl.[2] ..... A47C 7/72

[52] U.S. Cl. ..... 297/180; 5/347; 98/2.03; 98/DIG. 11; 297/453

[58] Field of Search ..... 5/284, 347; 98/2.03, 98/5; 297/180, 453

[56] References Cited

U.S. PATENT DOCUMENTS

| | | | |
|---|---|---|---|
| 1,568,471 | 1/1926 | Roemer | 297/453 |
| 2,241,755 | 5/1941 | Zaccone | 98/2.03 |

*Primary Examiner*—James C. Mitchell

[57] ABSTRACT

A convectively air-ventilated furniture comprises an elongated and hollow member having a lower end with an air inlet opening thereat and an upper end with an air exit opening thereat. A massive and elongated convective air channel extends from the air inlet opening to the air exit opening inside the hollow member. The contact areas between the user of the furniture and the top surface of the member are thermally conductive so that the body heat of the user heats up the air inside the hollow member thereby, through chimney effect, initiating and maintaining in the air channel a convective air current directed from the air inlet opening toward the air exit opening and substantially increasing the rate of heat transfer between the user and the air inside the hollow member.

16 Claims, 3 Drawing Figures

CONVECTIVELY AIR-VENTILATED FURNITURE

FIELD

This invention relates to air-ventilated furnitures and more particularly to convectively air-ventilated seats, beds, and the like.

THE PRIOR ART

Air-ventilated beds are not common. Air-ventilated seats are, however, widely used in cars and trucks. The common ventilated seat generally has horizontal seat member for the person to sit on and a back member for the back of the person to lean against. The material of these members are air-permeable. Air can, therefore, enter and exit at all places and in all directions. As a result, there is no regulated air movement and no single, major or streamlined air flow that can effectively remove heat and moisture from the body of the person for discharge into the surrounding air. This heat and moisture removal is also difficult because of the many dead air spaces which are invariably present. The seat is thus stuffy and uncomfortable, even when used in an air-conditioned area.

Accordingly, an object of the invention is to provide air-ventilated furnitures of improved designs and constructions;

Another object is to provide highly efficient, convectively air-ventilated furnitures with massive convective air currents flowing systematically therein;

A further object is to provide convectively air-ventilated furniture with massive convective air currents initiated by the body heat of the user of the furniture;

Yet another object is to provide convectively air-ventilated furniture with unique regulators for automatically controlling the heat and moisture removal from the human body of the user to the surrounding air according to local demands.

SUMMARY

To these ends, the present invention provides a convectively air-ventilated bed, seat, or other furniture having an elongated and hollow member made into an air-tight structure except for an air inlet opening at a lower portion thereof and an air exit opening at an upper portion thereof. Inside the elongated hollow member is a streamlined, massive air channel. The contact surfaces of the member are in heat and/or moisture communicative relation with the user of the furniture so that the body heat of the user heats up the air inside the hollow member thereby, through chimney effect, initiating and maintaining a strong convective air current inside the massive air channel.

BRIEF DESCRIPTION

The invention and its further objects and features will be more clearly understood from the following detailed description taken in conjunction with the drawing in which.

DETAILED DESCRIPTION

It will be understood that the specific embodiments described herein merely illustrate the general principles and features of the invention, and that various modifications and combinations or changes in forms and details of the different embodiments may be made by those skilled in the art without departing from the spirit and scope of the invention.

Figure 1:
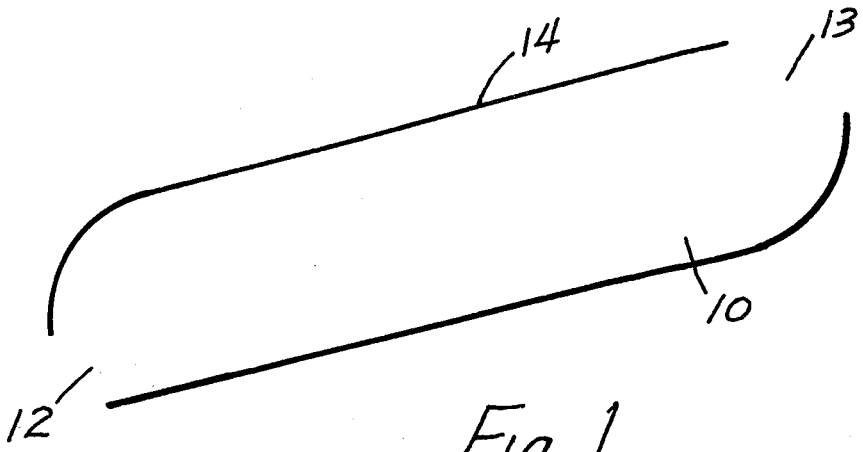
FIG. 1 is a cross-section of a convectively air-ventilated bed according to the invention.

FIG. 1 shows a convectively air-ventilated bed or bed pad. It has an elongated and hollow member 10 inclined from 15° to 60° to the horizontal. The greater the inclination, of course, the greater the convective air cooling. The member has a streamlined interior terminating at an air inlet opening 12 at its lower end and also at an air exit opening 13 at its upper end. The top surface 14, for the user of the bed to sleep on, is thermally conductive so that the body of the user heats up the air inside the hollow member. This heating lowers the density of air inside the hollow member 10. The heated air then rises and, through chimney effect, initiates and maintains a strong convective air current directed from the air inlet opening 12 toward the air exit opening 13 along the streamlined interior or air channel. This convective air current markedly increases the rate of heat transfer between the body of the user and the air inside the hollow member 10. To further improve the heat transfer and moisture removal from the user's body, the contact surface 14 is made air-permeable. Note that moisture has a molecular weight 18 compared to that of air 30 so that moisture in the air also lowers its density and, hence, enhances the convective air current inside the hollow member 10. This member comprises a sheet material enclosing an internal structure (not shown) which supports the weight of the user without obstructing the streamlined air flow in the member 10. Plastic and rubber are suitable sheet materials because they insulate thermally and are air-tight, leaving only the two air openings 12 and 13 and the contact surface 14 air-permeable for the heat and moisture transfer. The member 10 can also be cast in one piece.

Figure 2:
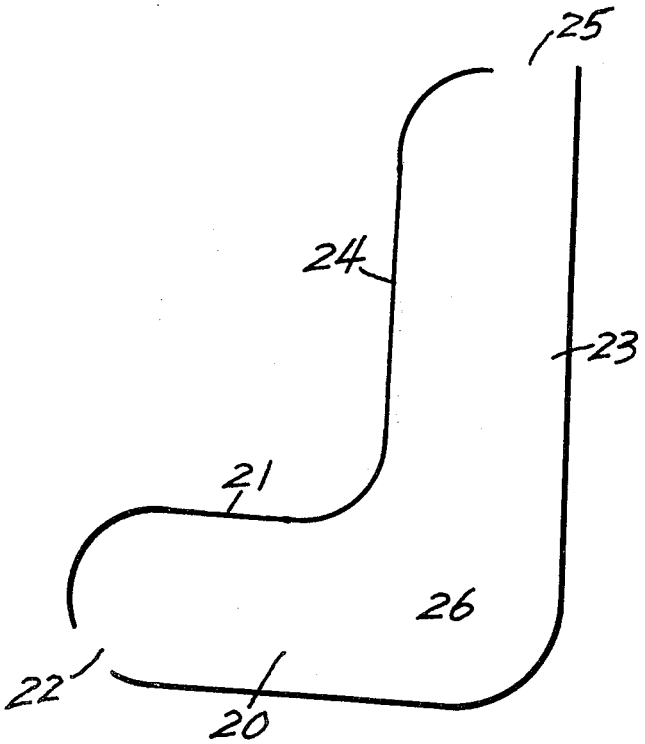
FIG. 2 is a cross-section of a convectively air-ventilated seat of the invention.

The convectively air-ventilated seat of FIG. 2 has a hollow, generally horizontal seat member or portion 20 measuring 15–30 inches high by 16–18 inches wide. The seat portion 20 has a top seating surface 21 for the person to sit on. This seating surface may be exactly horizontal but may also be inclined up to ± 15° to the horizontal. At the front end of the seat portion 20 is an air inlet opening 22 measuring at least ½ inch wide by up to half or the whole width of the seat portion. The seat also has a generally vertical, back portion 23 which has a front surface 24 measuring about 14–34 inches high by 16–18 inches wide, for the back of the sitting person to rest against. The back portion 23 has an air exit opening 25 at least ½ inch wide by up to half or the whole width of the back portion 23 at the top. The lower end of the back portion 23 is joined at 26 air-tightly to the rear end of the seat portion 20 so as to form a generally L-shaped seat structure. The seat and back portions are internally interconnected to form a massive convective air path or channel extending from the air inlet opening 22 to the air exit opening 25, inside and across the entire length of both these hollow portions 20 and 23. The front surface of the back portion is thermally conductive so that the body heat of the sitting person heats up the air inside the hollow back portion 23 thereby initiating and maintaining the convective air current inside the streamlined air channel. The streamlining of the air channel minimizes the resistance to the formation and flow of the convective air current and, hence, improves the heat transfer efficiency. Another way to further improve this efficiency is to make the top surface 21 of the hollow seat portion 20 also thermally conductive, so as to cause more heating and density lowering, of the air inside the two hollow portions 20 and 23.

Like the top surface 14 in the bed of FIG. 1, the front surface 24 of the back portion 23 and the top surface 21 of the seat portion 20 need not be metal to be thermally conductive. Thin (less than ⅛ inch thick) plastic, rubber, fabric, or other sheet materials may also conduct enough heat to be useful. Thin sheet materials, however, require an internal structure (not shown) to support the weight of the sitting person. These thin sheet materials may also be air-permeable so that moisture of the body can also be removed, to pass through the sheet materials into the convective air current in the air channel.

Figure 3:
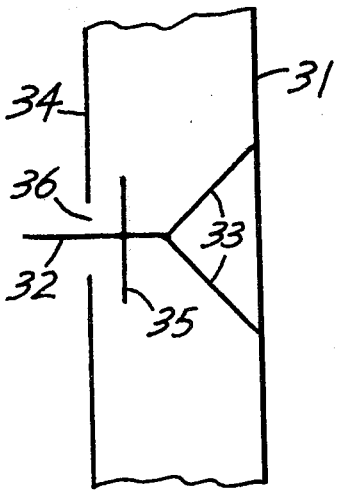
FIG. 3 shows some details of a regulating device for automatically controlling the local heat and moisture flow across the contact surface of the furniture shown in FIG. 1 or FIG. 2.

To enhance the convective air current, the hollow member 10 of FIG. 1 and the two seat and back portions of FIG. 2 should be air-tight and thermally insulating, except for the two air openings and the contact areas between the body of the user or sitting person and the contacting surfaces 14, 21, or 24. The contact areas may be equipped with a large number of regulating devices to sense the body contact and selectively regulate the heat or moisture flow at the local contact areas. That is, where there is body contact, there is heat and moisture flow, and not otherwise. This avoids unwanted air entrances at the noncontacted areas so as to maintain a massive, regulated convective air current. One type of these regulating devices, as shown in FIG. 3, has springy or resilient feet 33 connected to, e.g., the back surface 31 of the back member 23. The feet support the sensing finger 32 protruding out of the front surface 34. For each such regulating device, the surface 24 has an opening 36 which is normally closed by the flap 35 mounted on the finger 32. Human contact on the finger 32 pushes the flap 35 inward and opens the opening 36 for heat and moisture flow therethrough. The entire structure of FIG. 3 can be made of a single moulded rubber or plastic body or of several moulded rubber or plastic bodies joined together by, e.g., gluing. Alternately, sheet materials may be used with the feet 33, finger 32, and flap 35 properly assembled thereto.

To improve comfort, the hollow member 10 of FIG. 1 and the back and seat portions 23 and 20 of FIG. 2 should be contoured to fit the body contour of the user or sitting person. Alternately, the contact surfaces may be flexible and resilient, so as to automatically adjust and fit the body contour. The joint at 26 in FIG. 2 should also be flexible and adjustable for added comfort. The contact areas, which should be heat and moisture permeable, may be made of thin (less than ⅛ inch thick) rubber or plastic sheet materials with or without perforations or holes. When the regulating system of FIG. 3 is employed, even thick (over ¼ inch thick) materials may be used for the heat and moisture conduction at the contacting surfaces 14, 21, and 24.

If in FIG. 2 the seat member 20 is elongated to about 6 or 7 feet, and the back member 23 shortened to as small as 6 inches, a lounge chair or bed is formed. If the seat member 20 is over 6 feet long and inclined 15°–50° to the horizontal, the back member 23 can even be dispensed with, in which case the air exit opening 25 is relocated to the position 26 on the seat member 20. Alternately, the back member 23 of FIG. 2 can be turned at the joint 26 to flatten the seat or chair into an inclined furniture such as bed, if the combined length of the seat and back member exceeds 6 to 7 feet for adult or only 18 inches for children or infants.

The convectively air-ventilated bed, chair, or other furniture of this invention can, of course, be used in cars, trucks, boats or other vehicles. However, they can also be used in the home, office, factory, and the like. The entire, or key parts of, the bed, seat, or other furniture may be made substantially of the components described above. Alternately, the described embodiments may form only the pad, cushion, or attachment therefor, to be laid on the conventional chair, bed, or other furniture.

The air inlet opening 12 on the seat usually is directed toward the front of the car. A moving car will thus force air into the opening 12. A forced air-ventilated system thus obtains. This system may not need convective air ventilation. A more positive approach is to direct the ventilating hose on the car toward the opening 12 or 22 or, even better, air-tightly joined thereto.

What is claimed is:

1. A convectively air-ventilated furniture comprising:

an elongated and hollow member having a lower end and an upper end and having also a top contact surface for the user of the furniture to rest against;

first wall means defining an air inlet opening at the lower end;

second wall means defining an air exit opening at the upper end;

third wall means defining an elongated, convective air channel extending from the air inlet opening to the air exit opening inside the hollow member;

at least a major portion of the contact area between the user and the top contact surface being air impermeable but sufficiently thermally conductive so that the body heat of the user heats up the air inside the hollow member thereby, through chimney effect, initiating and maintaining in the air channel a significant convective air current directed from the air inlet opening toward the air exit opening and substantially increasing the rate of heat transfer between the user and the air inside the hollow member.

2. The furniture of claim 1 wherein except for the two air openings and the major portion of the contact area the surfaces of the hollow member is made of a heat insulating and moisture non-permeable material.

3. The furniture of claim 1 wherein the air channel is substantially streamlined to minimize the resistance to the formation and flow of the convective air current inside the hollow member.

4. The furniture of claim 1 wherein the top contact surface is contoured to fit the body contour of the user.

5. The furniture of claim 1 wherein the top contact surface is resilient thereby locally and automatically adjusting to the body contour of the user.

6. The furniture of claim 1 including a plurality of regulating means selectively located on the top contact surface and sensitive to localized contact of the user against the top contact surface to selectively regulate the heat transfer according to local demands.

7. The furniture of claim 1 including a plurality of valve means on the top contact surface and normally in closed positions, and including also means sensitive to the contact of the body of the user to open the valve means locally whereby only the valve means at the areas of body contact are selectively opened for localized heat removal while the remaining valve means are still closed to avoid unwanted air entrance and reduced convective air current.

8. The furniture of claim 1 in the form of a seat wherein the elongated and hollow member comprises:

a hollow, generally horizontal seat portion having a top seating surface for the user to sit thereon and having also the air inlet opening at a front part of the seat portion; and a hollow back portion in angular relation with the seat portion and having a front surface for the back of the user to rest against and having also the air exit opening at a top part of the back portion;

the lower end of the back portion joining in an air-tight form with the rear end of the seat portion so as to form a generally L-shaped seat structure;

the seat and back portions being internally interconnected to form the convective air channel extending across substantially the entire combined length of both the seat and back portions;

the front surface of the back portion being in sufficient heat communicative relation with the back of the user so that the body heat of the user substantially heats up the air inside the hollow back portion thereby, through chimney effect, initiating and maintaining the significant convective air current inside the air channel.

9. The furniture of claim 8 wherein the top surface of the hollow seat portion is also in significant heat communicative relation with the body of the user so as to further increase the rate of the heat transfer.

10. The furniture of claim 1 wherein the elongated and hollow member is a singular, substantially planar member having a substantially constant inclination of less than 60° from the horizontal.

11. The furniture of claim 1 wherein the top contact surface consists of a sheet material less than ¼ inch thick.

12. A convectively air-ventilated furniture comprising:

an elongated and hollow member having a lower end and an upper end and having also a top surface for the user of the furniture to rest against;

first wall means defining an air inlet opening at the lower end;

second wall means defining an air exit opening at the upper end;

third wall means defining an elongated, convective air channel extending from the air inlet opening to the air exit opening inside the hollow member;

the contact area between the user and the top surface being sufficiently air-permeable so that the moisture from the user lowers the density of the air inside the hollow member thereby, through chimney effect, initiating and maintaining in the air channel a significant convective air current directed from the air inlet opening toward the air exit opening and substantially increasing the rate of moisture removal from the user into the convective air current, the non-contacted area of the top surface being air-tight to avoid air communication therethrough thereby enhancing the strength of the convective air current.

13. The furniture of claim 12 wherein the elongated and hollow member is a singular, substantially planar member.

14. The furniture of claim 12 wherein the top surface consists of a sheet material less than ¼ inch thick.

15. The furniture of claim 12 for use inside a generally enclosed compartment and wherein the exit opening is located inside the compartment.

16. The furniture of claim 1 for use inside a generally enclosed compartment and wherein the exit opening is located inside the compartment.

* * * * *